US008372260B1

(12) United States Patent
Staerzl et al.

(10) Patent No.: US 8,372,260 B1
(45) Date of Patent: Feb. 12, 2013

(54) MARINE DRIVE CATHODIC PROTECTION SYSTEM WITH ACCURATE DETECTION OF REFERENCE POTENTIAL

(75) Inventors: Richard E. Staerzl, Fond du Lac, WI (US); Michael M. Blackwood, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 89 days.

(21) Appl. No.: 13/094,917

(22) Filed: Apr. 27, 2011

(51) Int. Cl.
*C23F 13/02* (2006.01)
*C23F 13/04* (2006.01)
*C23F 13/20* (2006.01)
*C23F 13/22* (2006.01)

(52) U.S. Cl. ..... 205/727; 205/725; 205/730; 205/740; 204/196.02; 204/196.04; 204/196.06; 204/196.07; 204/196.22; 204/196.24

(58) Field of Classification Search ..... 204/196.02, 204/196.04, 196.06, 196.07, 196.22, 196.24, 204/196.25, 196.37; 205/725, 727, 730, 205/740
See application file for complete search history.

(56) References Cited

U.S. PATENT DOCUMENTS 3,953,742 A * 4/1976 Anderson et al. ..... 204/196.03
4,322,633 A 3/1982 Staerzl
4,492,877 A 1/1985 Staerzl
4,528,460 A 7/1985 Staerzl
5,747,892 A 5/1998 Staerzl
5,840,164 A 11/1998 Staerzl
6,173,669 B1 1/2001 Staerzl
6,183,625 B1 * 2/2001 Staerzl ..... 205/727
6,209,472 B1 4/2001 Staerzl
6,547,952 B1 4/2003 Staerzl
6,822,462 B1 11/2004 Staerzl
6,841,059 B1 1/2005 Staerzl
6,973,890 B1 12/2005 Staerzl
7,025,013 B1 4/2006 Staerzl et al.
7,064,459 B1 * 6/2006 Staerzl ..... 307/95
7,131,877 B1 11/2006 Staerzl
7,186,320 B1 3/2007 Staerzl et al.
7,211,173 B1 5/2007 Staerzl et al.
7,381,312 B1 6/2008 Misorski et al.
7,686,936 B1 3/2010 Staerzl et al.
8,118,983 B1 * 2/2012 Anderson et al. ..... 204/196.11
2007/0251834 A1 * 11/2007 Bollinger ..... 205/727

* cited by examiner

*Primary Examiner* — Bruce Bell
(74) *Attorney, Agent, or Firm* — Andrus, Sceales, Starke & Sawall, LLP

(57) ABSTRACT

A marine drive cathodic protection control circuit and method controls ohmic current from a power source to an anode according to electrical reference potential sensed by a reference electrode. The ohmic current is interrupted for an interruption interval, and reference potential is sensed during the interruption interval. The ohmic current is controlled according to reference potential sensed during the interruption interval.

16 Claims, 3 Drawing Sheets

MARINE DRIVE CATHODIC PROTECTION SYSTEM WITH ACCURATE DETECTION OF REFERENCE POTENTIAL

BACKGROUND AND SUMMARY

The invention relates to marine drive cathodic protection systems.

Marine drive cathodic protection systems are known in the prior art. It is known that a marine drive can be cathodically protected from corrosion by supplying electrical current from a power source to an anode for flow through water as anodic ionic current to a cathode provided by a submerged metal section of the marine drive. A current controller operates to maintain the surface of the marine drive at a desired potential by supplying current to the anode in response to electrical reference potential sensed by a reference electrode, whereby to impress voltage across the load presented by the junction of the surface of the marine drive and the water in which the marine drive is submerged.

It is known to provide shielding for the reference electrode from the anodic ionic current, e.g. by providing a shield blocking or diverting electric field flux lines, or by providing spatial distance between the anode and the reference electrode diminishing electric field flux line intensity. It is also known to provide a variable bias signal to a power transistor controlling the amount of anode current, which bias signal increases as the anode current increases. The increasing bias signal compensates for the voltage drop through the water between the reference electrode and the noted load, which increases with anode current and serves to hold the potential at the surface of the protected marine drive essentially constant, regardless of the anode current.

The present disclosure arose during continuing development efforts in the above technology. In one aspect, the disclosure eliminates the need for shielding the reference electrode from anodic ionic current, whether by a shield blocking or diverting electrical field flux lines, or by a shield provided by spatial distance between the anode and the reference electrode diminishing electric field flux line intensity. In another aspect, the disclosure eliminates the sensing of anodic ionic current induced voltage in the reference potential sensed by the reference electrode and the need to compensate same.

DETAILED DESCRIPTION

Figure 1:
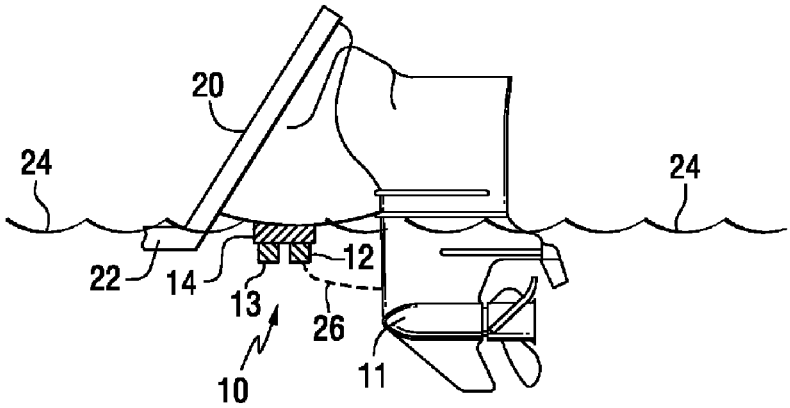
FIG. 1 PRIOR ART
FIG. 1 is a side schematic view of a marine drive with a cathodic protection system and is taken from FIG. 1 of U.S. Pat. No. 4,528,460, incorporated herein by reference.

FIG. 1 is taken from FIG. 1 of incorporated U.S. Pat. No. 4,528,460 and uses like reference numerals where appropriate to facilitate understanding. Marine drive 11 is illustrated as a stem drive attached to the transom 20 of a marine vessel 22 in a body of water 24. Cathodic protection system 10 includes an anode 12 and a reference electrode 13 mounted on the protected drive unit 11 and electrically insulated therefrom by a suitable insulating layer 14, all as in the incorporated '460 patent. In the '460 patent and other cathodic protection systems, and in the present disclosure, to be described, electrical ohmic direct current is supplied from a power source, e.g. a battery, to the anode for flow through the water as anodic ionic current, shown in dashed line at 26, to a cathode provided by a submerged metal section of the marine drive. A current controller controls the ohmic current from the power source to anode 12 according to electrical reference potential sensed by reference electrode 13. The anode current is variably controlled in order to maintain the potential of the surface of marine drive unit 11 essentially constant, which is desired in the incorporated '460 patent and other marine drive cathodic protection systems and in the present disclosure.

Figure 2:
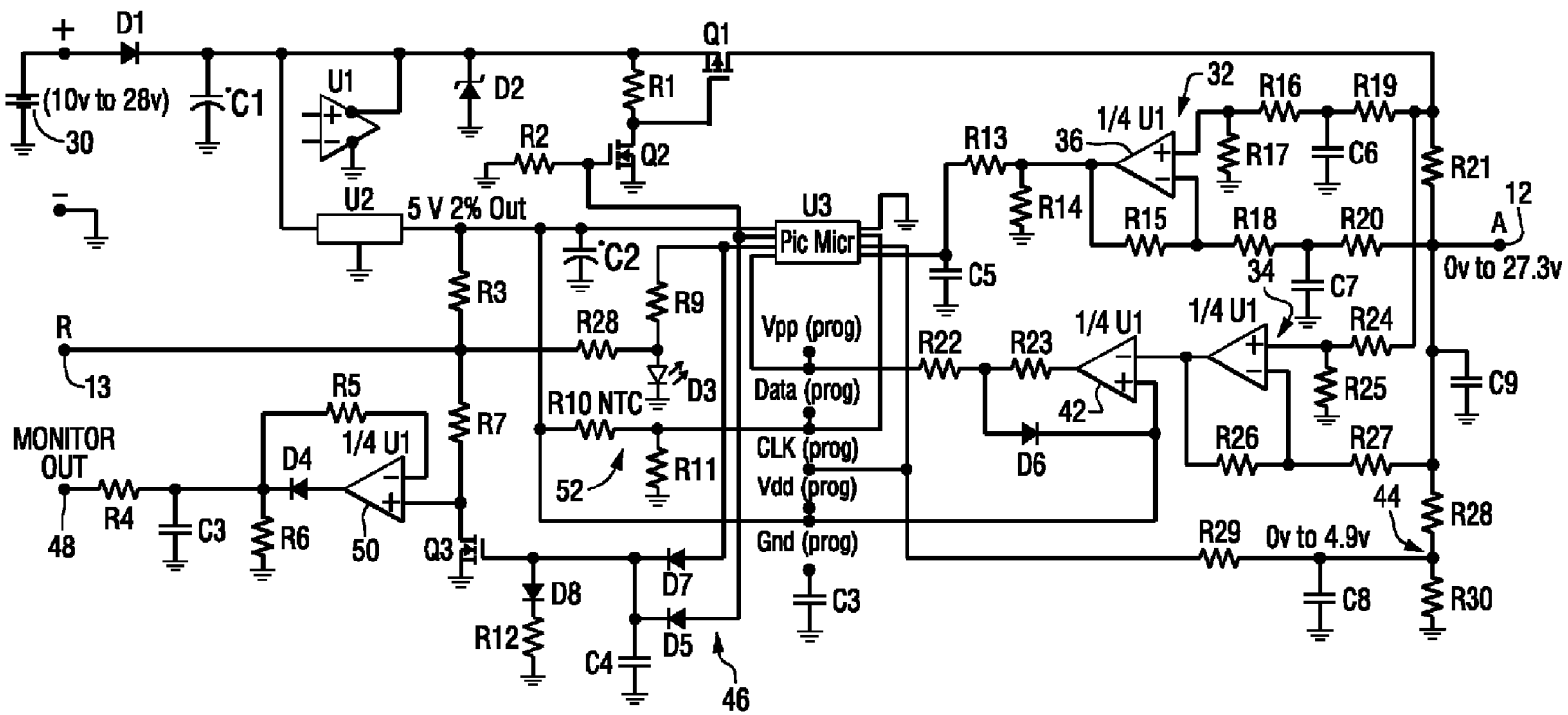
FIG. 2 is a circuit diagram of a marine drive cathodic protection system in accordance with the present disclosure.

Referring to FIG. 2, electrical ohmic current is supplied from a power source such as battery 30 through diode D1, FET (Field Effect Transistor) Q1, or other electronic power switch, and resistor R21 to anode 12 for flow through the body of water 24, FIG. 1, as anodic ionic current, as shown at 26, to a cathode provided by a submerged metal section of marine drive unit 11. The ohmic current from power source 30 to anode 12 is controlled according to electrical reference potential sensed by reference electrode 13. The flow of ohmic current from power source 30 to anode 12 is interrupted, to be described, for an interruption interval. The reference potential at reference electrode 13 is sensed during the interruption interval. The ohmic current from power source 30 to anode 12 is controlled according to the reference potential sensed by reference electrode 13 during the interruption interval. The ohmic current from power source 30 to anode 12 is controlled according to the reference potential sensed by reference electrode 13 during the interruption interval while there is no ohmic current flowing from power source 30 to anode 12. This eliminates sensing of anodic ionic current in the water at reference electrode 13 while controlling ohmic current supplied from power source 30 to anode 12. This is accomplished by interrupting the ohmic current from power source 30 to anode 12 during the interruption interval, and using the electrical reference potential sensed at reference electrode 13 during such interruption interval to control ohmic current being supplied from power source 30 to anode 12. This eliminates the need for shielding a reference electrode from anodic ionic current, and, in the absence of shielding, eliminates the sensing of anodic ionic current induced voltage in the reference potential sensed by the reference electrode and the need to compensate same. The noted shielding is otherwise provided by a shield blocking or diverting electric field flux lines, the need for which shielding is eliminated in the present disclosure. The noted shielding can also otherwise be provided by spatial distance between the anode and the reference electrode diminishing electric field flux line intensity, the need for which such shielding is eliminated in the present disclosure. In the absence of shielding, the noted anodic ionic current induced voltage is otherwise sensed in the reference potential sensed by the reference electrode and otherwise requiring compensation of same, the need for which such compensation is eliminated in the present disclosure. The noted shielding and/or compensation may be used if desired in the present disclosure, or may be omitted if desired, because the need for same has been eliminated.

The electronic power switch provided by FET Q1, FIG. 2, is in series between power supply 30 and anode 12. A filter capacitor is provided at C1 through diode D1, and a clamping Zener diode D2. A gating or triggering FET is provided at Q2 through resistor R1 for gating Q1 between conductive and non-conductive states. Conduction of Q2 is controlled by a control signal through resistor R2 from electronic controller U3, which in one embodiment is a Microchip micro controller part number PIC12F675, available from Microchip Technology Inc. A voltage regulator for electronic controller U3 is provided at U2 providing a five volt regulated output filtered at capacitor C2. The control signal at the output of electronic controller U3 provided to triggering gating FET Q2 switches the electronic power switch FET Q1 between conductive and non-conductive states to provide on and off intervals of direct current flow from power supply 30 to anode 12. The off interval provides the noted interruption interval. The ratio of the relative duration of the on and off intervals is determined by the level of reference potential sensed by reference electrode 13 during the off interval, and by anode current, to be described.

First and second electronic current monitoring switches are provided at 32 and 34, respectively, each sensing direct current flow from power supply 30 through electronic power switch Q1 and resistor R21 to anode 12. First electronic current monitoring switch 32 is provided by one-fourth of a quad differential amplifier U1, as shown at component 36, controlling the noted ratio of relative duration of the noted on and off intervals. The voltage drop across resistor R21 due to the direct current flow therethrough is sensed at the non-inverting input of component 36 through resistor R19, capacitor C6, resistor R16, and resistor R17, and is sensed at the inverting input of component 36 through resistor R20, capacitor C7, resistor R18, and feedback resistor R15. When the direct current flow through resistor R21, and hence the voltage thereacross, rises above a given level, as sensed at the non-inverting input of component 36 compared against the inverting input of the latter, the differential amplifier component at 36 outputs a command signal at resistor R14, resistor R13, and capacitor C5 to electronic controller U3 which in turn outputs a control signal through Q2 to switch Q1 to its non-conductive state. When the direct current flow through resistor R21, and hence the voltage thereacross, drops below a designated level, the voltage at the inverting input of differential amplifier component 36 rises above the voltage at its non-inverting input, and differential amplifier component 36 outputs a turn-on signal to controller U3 to command the latter to output a control signal through Q2 to switch Q1 to its conductive state. In one embodiment, a typical switching frequency of Q1 between its conductive and non-conductive states may be in the range of 10 Hz with a duty cycle of 75% on and 25% off, in pulse-width modulated manner, having a duty cycle according to the noted ratio.

The noted second electronic current monitoring switch 34 in one embodiment provides an electronic safety switch sensing direct current flow from power supply 30 through electronic power switch Q1 and resistor R21 to anode 12 during the noted on interval, and immediately switching Q1 to its non-conductive state if the noted direct current flow rises above a given threshold. One-fourth of the noted quad differential amplifier U1 as shown at component 40 senses the noted direct current flow by the voltage drop across resistor R21 as sensed at the non-inverting input of component 40 through resistors R24 and R25, and at the inverting input of component 40 as sensed through capacitor C9, resistor R27, and feedback resistor R26, and outputs a signal to the inverting input of differential amplifier component 42, which is another one-quarter of the noted quad differential amplifier U1, for comparison against the reference voltage from voltage regulator U2 supplied to the non-inverting input of component 42 at feedback diode D6. When the noted direct current flow rises above the noted given threshold, as determined by the voltage drop across resistor R21 and the noted comparison against the regulated voltage, e.g. five volts, from voltage regulator U2, differential amplifier component 42 outputs through resistors R23 and R22 a shut-down signal to electronic controller U3 to command the latter to provide an immediate overriding disconnect signal to Q2 overriding the noted control signal and immediately switching Q1 to its non-conductive state.

An initialization-protection circuit 44 is provided to detect for shorts before turn-on of the system. Current at anode 12 is detected by resistors R28, R30, capacitors C8, C9, and resistor R29 to provide a turn-on prevention signal to electronic controller U3 to prevent turn-on of Q1 to its conductive state through Q2.

A disable circuit 46 is responsive to the noted control signal from controller U3 switching Q1 to its conductive state through Q2, which disable circuit 46 disables sensing of electrical reference potential at the input of controller U3 from reference electrode 13, whereby reference potential from reference electrode 13 is sensed only during the noted interruption interval with electronic power switch Q1 in its non-conductive state. Disable circuit 46 senses the noted control signal through diode D7, diode D5, capacitor C4, diode D8, resistor R12 to trigger FET Q3 into conduction to in turn shunt to ground through resistor R7 the signal from reference electrode 13, thus disabling sensing of the reference potential at the input of controller U3 through resistors R8 and R9. A light emitting diode D3 provides visual confirmation of the sensed reference potential. Resistor R3 provides a pull-up resistor to the output of voltage regulator U2. A terminal may be provided at 48 for output to a monitor or the like for monitoring reference potential, as supplied through the remaining one-fourth of the noted quad differential amplifier U1 as shown at component 50, and diode D4, feedback resistor R5, resistor R6, filtering capacitor C3, and resistor R4.

Disable circuit 46 may include a delay circuit as provided at capacitor C4 delaying for a given delay the sensing of the reference potential by the reference electrode at the beginning of the noted interruption interval when ohmic current stops flowing from the power source to the anode and anodic ionic current stops flowing from the anode through the water to the cathode.

A thermally responsive over-temperature protection circuit 52 has an output at resistor R11 supplied to electronic controller U3 to limit the amount of ohmic current called for by the noted control signal at the output of controller U3 supplied to Q2 to trigger Q1 into conduction. In one embodiment, the thermally responsive over-temperature protection circuit is provided by an NTC (Negative Temperature Coefficient) thermistor R10 connected between the output of voltage regulator U2 and controller U3.

Figure 3:
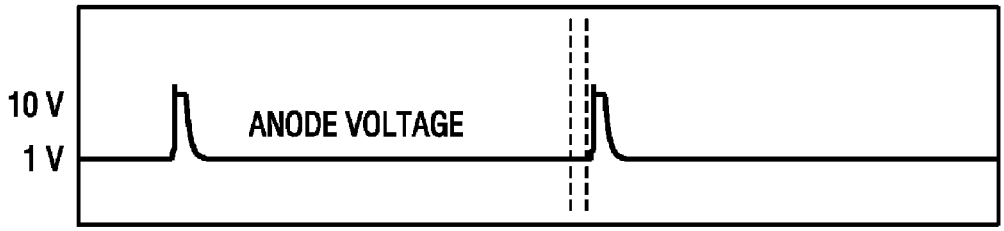
FIG. 3 is a graph showing anode voltage.
Figure 4:
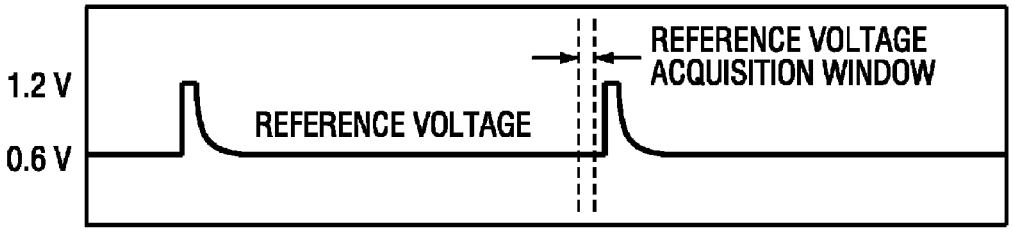
FIG. 4 is a graph showing reference voltage.

Prior art cathodic protection systems having a class A current controller have an active element which remains conducting all the time. These systems are inefficient and suffer power dissipation, including in the form of heat. These systems also require the above noted shielding and/or the above noted compensation, including as the resistance of the active element is modified while it remains on. The present disclosure switches the electronic power switch Q1 between conductive and non-conductive states, resulting in increased efficiency because such element is not on all of the time. Reference electrode accuracy is significantly improved because its reference potential is sensed when anode current is off. FIG. 3 shows anode voltage switching between 1 volt and 10 volts, and FIG. 4 shows reference voltage switching between 0.6 volts and 1.2 volts due to the noted anodic ionic current, without the noted shielding and without the noted compensation. In the present disclosure, as shown in FIG. 4 at the reference voltage acquisition window, reference voltage is sensed during the noted off interval. There is no need for the noted shielding nor the noted compensation because there is no anodic ionic induced voltage in the sensed reference voltage.

Figure 5:
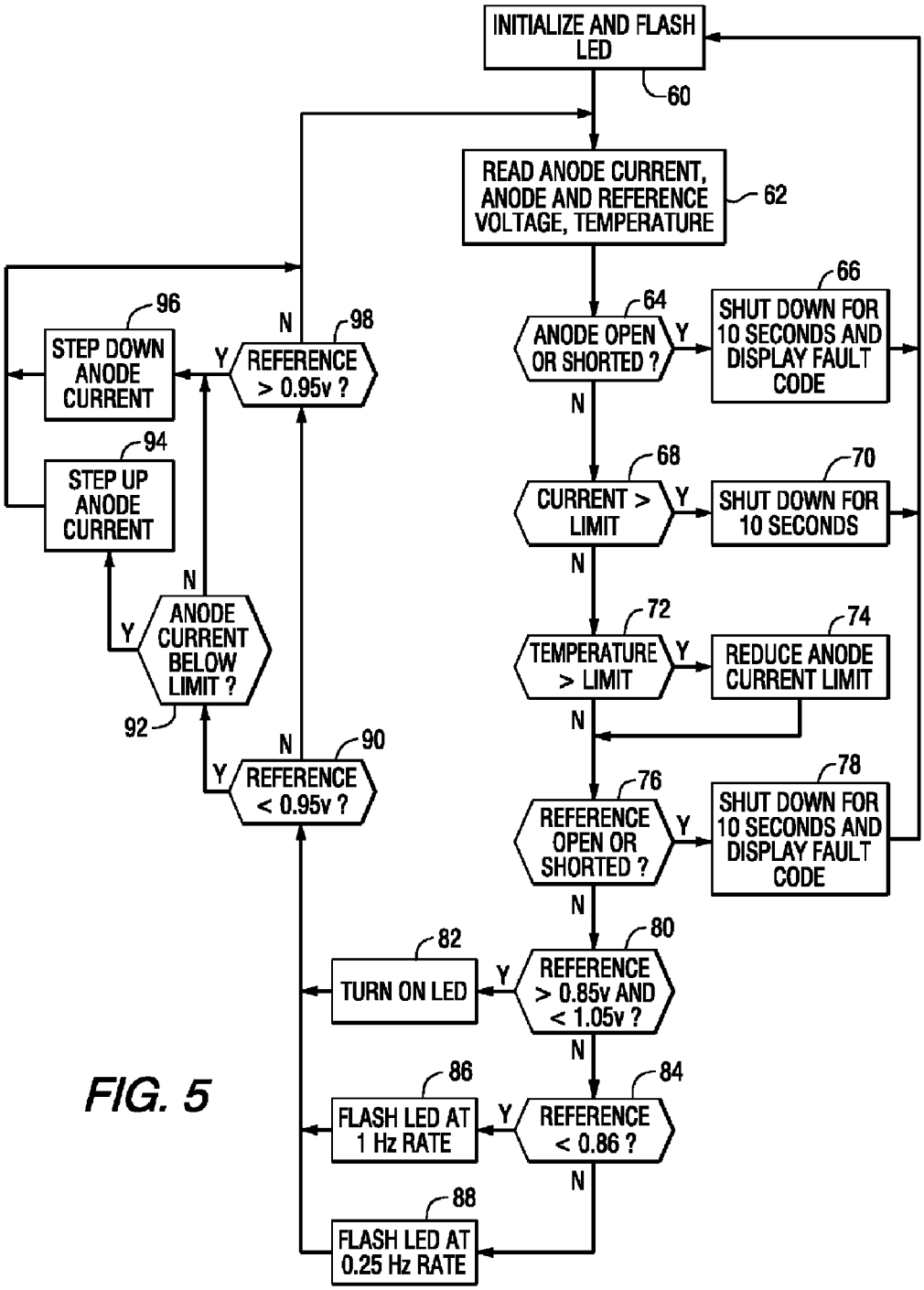
FIG. 5 is a decision tree flow chart illustrating cathodic protection system operation.

FIG. 5 illustrates operation in a decision tree flow chart. At start-up step 60, the circuit is initialized and an LED is flashed. At step 62, anode current, anode and reference voltage and temperature are read. At step 64, if an anode open or short is sensed, e.g. by circuit 44, then at step 66 the system is shut down for 10 seconds and a fault code is displayed. If no anode open or short is detected, then at step 68 the anode current is checked and if above the given limit then at step 70 the system is shut down, e.g. by circuit 34, for 10 seconds. If the anode current is not above the given limit, then at step 72 temperature is checked and if the temperature is above a given limit then at step 74 the anode current limit is reduced. If the temperature is not above the given limit, then at step 76 the reference electrode is checked for an open or short, and if so then at step 78 the system is shut down and a fault code is displayed. If no reference electrode open or short is detected, then at step 80 the level of reference voltage is checked, and if greater than 0.85 volts and less than 1.05 volts, then an LED is turned on at step 82. If the reference voltage is outside the noted range then at step 84 the reference voltage is checked to determine if it is less than 0.86 volts, and if so then at step 86 the LED is flashed at a 1 Hz rate, and if not, at step 88 the LED is flashed at a 0.25 Hz rate. Then at step 90, the reference voltage is checked to determine if it is less than 0.95 volts, and if so, then at step 92 the anode current is checked to determine if it is below the given limit, and if so then at step 94 the anode current is stepped up, and if not then at step 96 the anode current is stepped down, followed by return to step 62. If the reference voltage at step 90 is not less than 0.95 volts, then at step 98 the reference voltage is checked to determine if it is greater than 0.95 volts, and if so, then at step 96 the anode voltage is stepped down, and if not, the system returns to step 62.

In the foregoing description, certain terms have been used for brevity, clearness, and understanding. No unnecessary limitations are to be inferred therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims. Each limitation in the appended claims is intended to invoke interpretation under 35 U.S.C. §112, sixth paragraph, only if the terms "means for" or "step for" are explicitly recited in the respective limitation.

What is claimed is:

1. A method for cathodically protecting a marine drive from corrosion, comprising supplying electrical ohmic current from a power source to an anode for flow through water as anodic ionic current to a cathode provided by a submerged metal section of said marine drive, controlling said ohmic current from said power source to said anode according to electrical reference potential sensed by a reference electrode interrupting said ohmic current from said power source to said anode for an interruption interval sensing said reference potential at said reference electrode during said interruption interval, and controlling said ohmic current from said power source to said anode according to said reference potential sensed by said reference electrode during said interruption interval controlling said ohmic current from said power source to said anode according to said reference potential sensed by said reference electrode during said interruption interval while there is no ohmic current flowing from said power source to said anode, eliminating sensing of anodic ionic current in the water at said reference electrode while controlling ohmic current supplied from said power source to said anode, comprising interrupting said ohmic current from said power source to said anode during said interruption interval, and using said reference potential sensed at said reference electrode during said interruption interval to control said ohmic current supplied from said power source to said anode, providing an electronic power switch in series between said power supply and said anode, providing an electronic controller having an output to said electronic power switch and having an input from said reference electrode responding to said reference potential sensed at said input from said reference electrode and outputting a control signal at said output to switch said electronic power switch between conductive and non-conductive states to provide on and off intervals of direct current flow from said power supply to said anode, said off interval providing said interruption interval, the ratio of the relative duration of said on and off intervals being determined by the level of said reference potential sensed by said reference electrode during said off interval.

2. The method according to claim 1 comprising providing an electronic safety switch sensing said direct current flow from said power supply through said electronic power switch to said anode during said on interval, and immediately switching said electronic power switch to said non-conductive state if said direct current flow rises above a given threshold.

3. The method according to claim 2 comprising providing said electronic safety switch with an output to said electronic controller, providing a shut-down signal from said electronic safety switch to said electronic controller in response to said direct current flow above said given threshold, and providing an immediate overriding disconnect signal from said output of said electronic controller overriding said control signal and immediately switching said electronic power switch to said non-conductive state.

4. The method according to claim 1 comprising providing in combination first and second electronic current monitoring switches each sensing direct current flow from said power supply through said electronic power switch to said anode, controlling with said first electronic current monitoring switch said ratio of relative duration of said on and off intervals, and controlling with said second electronic current monitoring switch the conduction of said electronic power switch to immediately switch said electronic power switch to said non-conductive state if said direct current flow rises above a given threshold.

5. The method according to claim 4 comprising providing said first and second electronic current monitoring switches as first and second differential amplifiers, respectively, each having an output to said electronic controller.

6. The method according to claim 1 comprising outputting said control signal from said output of said electronic controller to switch said electronic power switch between said conductive and non-conductive states in pulse-width modulated manner having a duty cycle according to said ratio.

7. The method according to claim 1 comprising providing a disable circuit responsive to said control signal switching said electronic power switch to said conductive state and disabling sensing of said reference potential at said input of said electronic controller from said reference electrode, whereby said reference potential from said reference electrode is sensed only during said interruption interval with said electronic power switch in said non-conductive state.

8. The method according to claim 1 comprising providing a thermally responsive over-temperature protection circuit having an output supplied to said electronic controller to limit the amount of said ohmic current called for by said control signal at said output of said electronic controller.

9. A cathodic protection circuit for a marine drive, comprising a power source supplying electrical ohmic current to an anode for flow through water as anodic ionic current to a cathode provided by a submerged metal section of said marine drive, an electronic power switch in series between said power source and said anode and controlling ohmic current flow through said electronic power switch to said anode according to electrical reference potential sensed by a reference electrode, said electronic power switch controlling said ohmic current by interrupting said ohmic current from said power source to said anode for an interruption interval, said reference potential being sensed at said reference electrode during said interruption interval, said ohmic current from said power source to said anode being controlled according to said reference potential sensed by said reference electrode during said interruption interval, an electronic controller having an output to said electronic power switch and having an input from said reference electrode and responding to said reference potential sensed at said input from said reference electrode and outputting a control signal at said output to switch said electronic power switch between conductive and non-conductive states to provide on and off intervals of direct current flow from said power supply to said anode, said off interval providing said interruption interval, the ratio of the relative duration of said on and off intervals being determined by the level of said reference potential sensed by said reference electrode during said off interval, an electronic safety switch sensing said direct current flow from said power supply through said electronic power switch to said anode during said on interval and immediately switching said electronic power switch to said non-conductive state if said direct current flow rises above a given threshold.

10. The cathodic protection circuit according to claim 9 comprising wherein said electronic safety switch has an output to said electronic controller and provides a shut-down signal to said electronic controller in response to said direct current flow above said given threshold, and wherein said output of said electronic controller outputs an immediate overriding disconnect signal overriding said control signal and immediately switching said electronic power switch to said non-conductive state in response to said shut-down signal from said electronic safety switch.

11. A cathodic protection circuit for a marine drive, comprising a power source supplying electrical ohmic current to an anode for flow through water as anodic ionic current to a cathode provided by a submerged metal section of said marine drive, an electronic power switch in series between said power source and said anode and controlling ohmic current flow through said electronic power switch to said anode according to electrical reference potential sensed by a reference electrode, said electronic power switch controlling said ohmic current by interrupting said ohmic current from said power source to said anode for an interruption interval said reference potential being sensed at said reference electrode during said interruption interval, said ohmic current from said power source to said anode being controlled according to said reference potential sensed by said reference electrode during said interruption interval an electronic controller having an output to said electronic power switch and having an input from said reference electrode and responding to said reference potential sensed at said input from said reference electrode and outputting a control signal at said output to switch said electronic power switch between conductive and non-conductive states to provide on and off intervals of direct current flow from said power supply to said anode, said off interval providing said interruption interval, the ratio of the relative duration of said on and off intervals being determined by the level of said reference potential sensed by said reference electrode during said off interval, in combination first and second electronic current monitoring switches each sensing direct current flow from said power supply through said electronic power switch to said anode, said first electronic current monitoring switch controlling said ratio of relative duration of said on and off intervals, said second electronic current monitoring switch controlling the conduction of said electronic power switch to immediately switch to said non-conductive state if said direct current flow rises above a given threshold.

12. The cathodic protection circuit according to claim 11 wherein said first and second electronic current monitoring switches comprise first and second differential amplifiers, respectively, each having an output to said electronic controller.

13. A cathodic protection circuit for a marine drive, comprising a power source supplying electrical ohmic current to an anode for flow through water as anodic ionic current to a cathode provided by a submerged metal section of said marine drive, an electronic power switch in series between said power source and said anode and controlling ohmic current flow through said electronic power switch to said anode according to electrical reference potential sensed by a reference electrode, said electronic power switch controlling said ohmic current by interrupting said ohmic current from said power source to said anode for an interruption interval, said reference potential being sensed at said reference electrode during said interruption interval, said ohmic current from said power source to said anode being controlled according to said reference potential sensed by said reference electrode during said interruption interval an electronic controller having an output to said electronic power switch and having an input from said reference electrode and responding to said reference potential sensed at said input from said reference electrode and outputting a control signal at said output to switch said electronic power switch between conductive and non-conductive states to provide on and off intervals of direct current flow from said power supply to said anode, said off interval providing said interruption interval, the ratio of the relative duration of said on and off intervals being determined by the level of said reference potential sensed by said reference electrode during said off interval, a disable circuit responsive to said control signal switching said electronic power switch to said conductive state and disabling sensing of said reference potential at said input of said electronic controller from said reference electrode, whereby said reference potential from said reference electrode is sensed only during said interruption interval with said electronic power switch in said non-conductive state.

14. A cathodic protection circuit for a marine drive, comprising a power source supplying electrical ohmic current to an anode for flow through water as anodic ionic current to a cathode provided by a submerged metal section of said marine drive, an electronic power switch in series between said power source and said anode and controlling ohmic current flow through said electronic power switch to said anode according to electrical reference potential sensed by a reference electrode, said electronic power switch controlling said ohmic current by interrupting said ohmic current from said power source to said anode for an interruption interval, said reference potential being sensed at said reference electrode during said interruption interval, said ohmic current from said power source to said anode being controlled according to said reference potential sensed by said reference electrode during said interruption interval an electronic controller having an output to said electronic power switch and having an input from said reference electrode and responding to said reference potential sensed at said input from said reference electrode and outputting a control signal at said output to switch said electronic power switch between conductive and non-conductive states to provide on and off intervals of direct current flow from said power supply to said anode, said off interval providing said interruption interval, the ratio of the relative duration of said on and off intervals being determined by the level of said reference potential sensed by said reference electrode during said off interval, a thermally responsive over-temperature protection circuit having an output supplied to said electronic controller to limit the amount of said ohmic current called for by said control signal at said output of said electronic controller.

15. A cathodic protection circuit for a marine drive, comprising a power source supplying electrical ohmic current to an anode for flow through water as anodic ionic current to a cathode provided by a submerged metal section of said marine drive, an electronic power switch in series between said power source and said anode and controlling ohmic current flow through said electronic power switch to said anode according to electrical reference potential sensed by a reference electrode, said electronic power switch controlling said ohmic current by interrupting said ohmic current from said power source to said anode for an interruption interval said reference potential being sensed at said reference electrode during said interruption interval, said ohmic current from said power source to said anode being controlled according to said reference potential sensed by said reference electrode during said interruption interval, a delay circuit delaying for a given delay the sensing of said reference potential by said reference electrode at the beginning of said interruption interval when said ohmic current stops flowing from said power source to said anode and said anodic ionic current stops flowing from said anode through said water to said cathode.

16. A cathodic protection circuit for a marine drive, comprising a power source supplying electrical ohmic current to an anode for flow through water as anodic ionic current to a cathode provided by a submerged metal section of said marine drive, an electronic power switch in series between said power source and said anode and controlling ohmic current flow through said electronic power switch to said anode according to electrical reference potential sensed by a reference electrode, said electronic power switch controlling said ohmic current by interrupting said ohmic current from said power source to said anode for an interruption interval, said reference potential being sensed at said reference electrode during said interruption interval, said ohmic current from said power source to said anode being controlled according to said reference potential sensed by said reference electrode during said interruption interval, a disable circuit disabling sensing of said reference potential by said reference electrode when said ohmic current is flowing from said power source to said anode and said anodic ionic current is flowing from said anode through said water to said cathode.

* * * * *